United States Patent [19]

Nation et al.

[11] Patent Number: 4,835,446

[45] Date of Patent: May 30, 1989

[54] HIGH FIELD GRADIENT PARTICLE ACCELERATOR

[75] Inventors: John A. Nation, Ithaca, N.Y.; Shlomo Greenwald, Haifa, Israel

[73] Assignee: Cornell Research Foundation, Inc., Ithaca, N.Y.

[21] Appl. No.: 100,267

[22] Filed: Sep. 23, 1987

[51] Int. Cl.[4] ..... H01J 25/10

[52] U.S. Cl. ..... 315/5.13; 315/5; 315/5.41; 315/39; 328/233; 328/256; 376/108; 376/120

[58] Field of Search ..... 315/3, 4, 5, 39.3, 5.13, 315/5.41, 39; 328/233, 256; 376/108, 120; 313/359.1

[56] References Cited

U.S. PATENT DOCUMENTS

| | | | |
|---|---|---|---|
| 2,398,162 | 12/1941 | Sloan | 315/39 |
| 2,474,938 | 9/1944 | Gorn | 315/40 |
| 2,591,350 | 4/1952 | Gorn | 315/39 |
| 2,932,797 | 4/1960 | Symon | 328/233 |
| 3,016,503 | 1/1962 | Pierce | 333/95 |
| 3,018,452 | 1/1962 | Friis et al. | 333/95 |
| 3,324,340 | 6/1967 | Pinel et al. | 315/3.5 |
| 3,332,024 | 7/1967 | Leboutet | 328/233 |
| 3,506,865 | 4/1970 | Briggs | 328/233 X |
| 3,906,300 | 9/1975 | Tran | 328/233 X |
| 3,958,189 | 5/1976 | Sprangle et al. | 330/4.3 |
| 4,331,936 | 5/1982 | Schlesinger et al. | 372/2 |
| 4,345,329 | 8/1982 | Doucet et al. | 372/2 |
| 4,490,648 | 12/1984 | Lancaster et al. | 315/5.41 |
| 4,494,040 | 1/1985 | Moretti | 315/5.41 |

*Primary Examiner*—Howard W. Britton
*Assistant Examiner*—Mark R. Powell
*Attorney, Agent, or Firm*—Jones, Tullar & Cooper

[57] ABSTRACT

A high electric field gradient electron accelerator utilizing short duration, microwave radiation, and capable of operating at high field gradients for high energy physics applications or at reduced electric field gradients for high average current intermediate energy accelerator applications. Particles are accelerated in a smooth bore, periodic undulating waveguide, wherein the period is so selected that the particles slip an integral number of cycles of the r.f. wave every period of the structure. This phase step of the particles produces substantially continuous acceleration in a traveling wave without transverse magnetic or other guide means for the particle.

16 Claims, 3 Drawing Sheets

FIG. 5
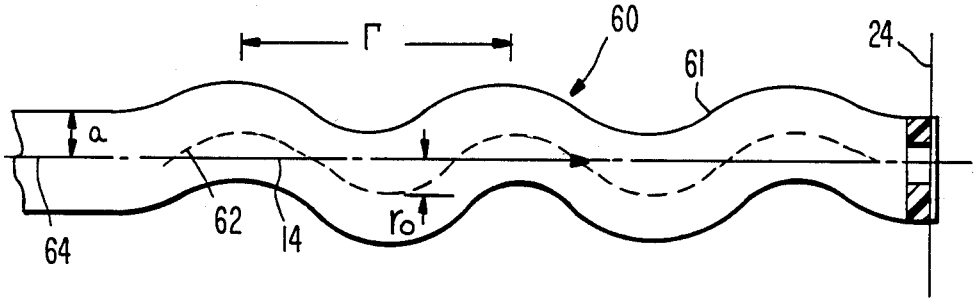
FIG. 6
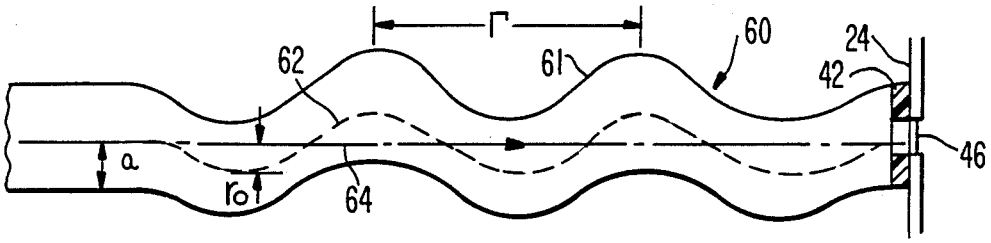
FIG. 7
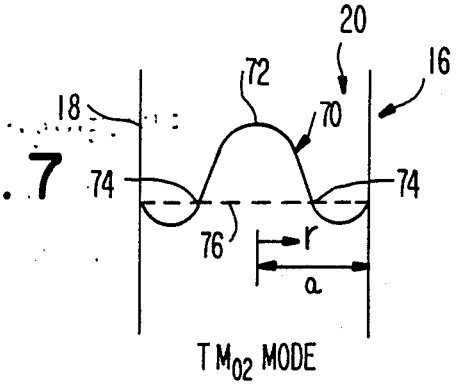
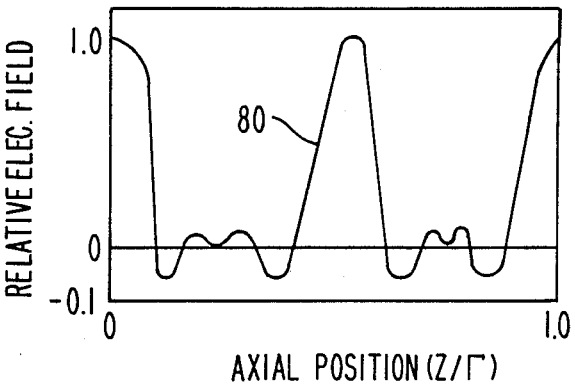
FIG. 8B

FIG. 9
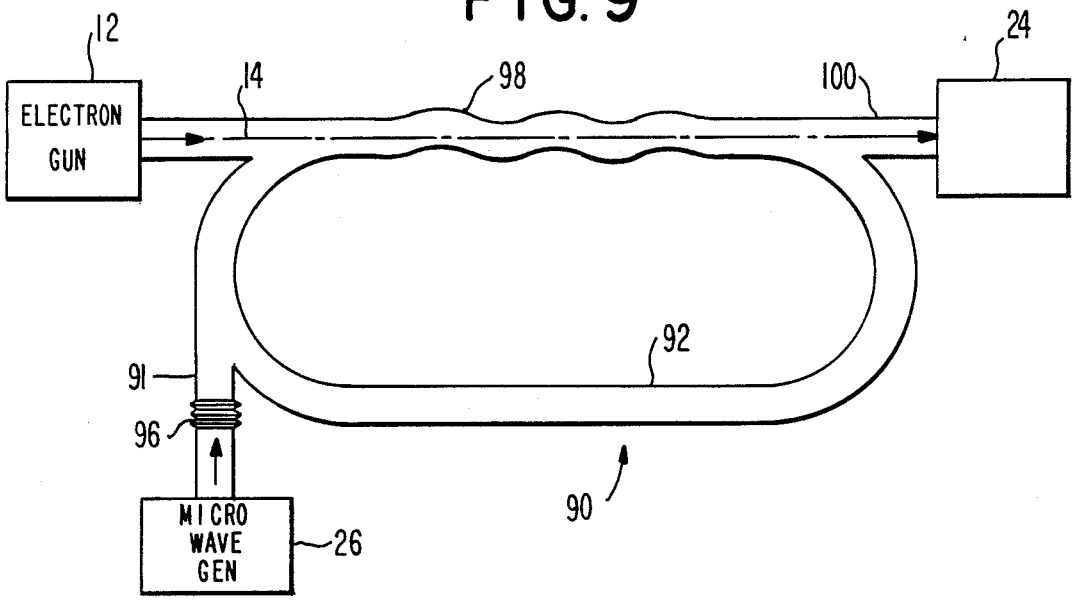
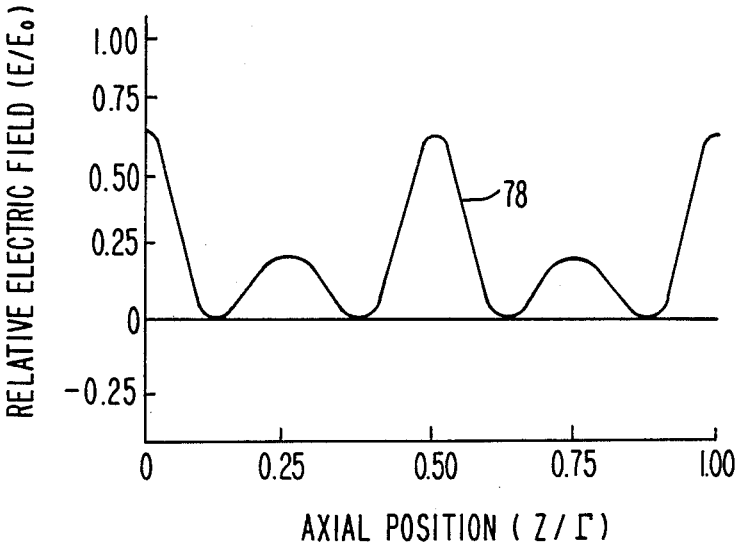
FIG. 8A

HIGH FIELD GRADIENT PARTICLE ACCELERATOR

This invention was made with Government support under Grant No. DE-AC02-80ER10569-A009 awarded by the Department of Energy, and under Grant No. 83-0364A awarded by the Air Force Office of Scientific Research. The Government has certain rights in the invention.

BACKGROUND OF THE INVENTION

The present invention relates, in general, to a high electric field gradient accelerator for particles, and more particularly to a pulsed microwave driven electron accelerator which may be used in high energy physics, or may be operated at a reduced electric field gradient to yield a compact, high average current intermediate energy accelerator.

The direct application of pulse power technology to particle acceleration has been studied for several years using single pulses. Modest successes have been reported and operating capabilities, for various accelerator configurations, defined experimentally and theoretically. Most of this work has been centered on the acceleration of ions in high current relativistic electron beams and is not readily scalable to the needs of high energy physics, although it does have potential applications in other areas.

Contemporary pulse power technology has its origins in the work of J. C. Martin who, in about 1962, used a Marx generator to charge a transmission line which was subsequently switched into a vacuum diode. The operating levels (~500 kV, 50 kA, 50 nsec.) achieved were comparable to or exceed most of the specifications for a source of interest for high energy particle accelerator development today, but was capable only of single shot operation. In the Marx generator the primary energy source, a bank of capacitors, was charged from a D.C. supply. The capacitors were then switched into a series configuration having an output capacitance of C/n and an output voltage of nV, where C is the capacitance of each capacitor, n the number of stages, and V the charging voltage. The output from the Marx generator was used to charge a transmission line which in turn was switched into a vacuum diode. Typically, the Marx generator charges the line in a time of the order of 500 nsec.

To move beyond the single shot pulse generator capabilities indicated above required the use of magnetic switching technology. In a magnetically switched pulse generator a repetitively pulsed source feeds a series of LC cascaded circuits in which the inductors are saturable reactors. Prior to use the cores are reset to their remnant magnetization state in the reverse sense to that to be used for the pulse generation. As the first inductor $L_n$ saturates and the first capacitor $C_n$ is fully charged, $C_{n+1}$ starts to charge. The pulse compression occurs in successive stages as a result of making the charging times for successive capacitors, and the corresponding saturation times for the inductors, smaller. The charging times scale is the square root of the ratio of the saturated inductances of successive saturable inductors. Thus magnetic switching, which really is magnetic pulse compression, may be used to replace the switch used in the pulse power transmission line. The final capacitor in the last stage is the conventional pulse line or Blumlein line which is used in single shot pulse power systems. An increase of about three can be obtained in the final output voltage pulse through the use of a three to one non-saturating step up transformer.

Most of the work to date in the area of collective acceleration of charged particles in high power beams has centered on the acceleration of positive ions, at moderately high field gradients, from a low energy injector. All of the techniques rely on waves carried on the beam, either as eigenmodes of an unneutralized beam in an evacuated drift tube or by solitary waves propagating at the beam head. In both cases the maximum phase velocity is the beam velocity and the maximum achievable ion energy will not approach energies of interest for high energy physics unless ways can be found to drive the wave phase velocity to values higher than the electron drift velocity.

High power microwave generation using intense relativistic electron beams started in the late 60's and was first reported by J. A. Nation, Applied Physics Letters 17, p. 491 (1970). Since that time there has been an ever increasing effort in this area.

In broad terms there are two regimes of interest for high power microwave generation. These are divided by regime according to the value of the ratio of the beam current to the limiting current, i.e., whether the beam current is greater than or less than the limiting current for the device. The limiting current phenomenon arises from the potential depression in the drift tube caused by the beam space charge. The potential depression decreases the electron velocity below its injection value and hence increases the beam density, which in turn increases the potential depression. The system is stable only for the regime in which the currents are less than the limiting value for the device being used.

Existing high energy accelerators have involved the use of complex structures within the accelerator cavity, and such devices have encountered difficulties since their high electric fields near the cavity walls can lead to breakdowns in the accelerator system. Further, the complex structures cause the particles to deviate from a straight-line path, resulting in high radiation losses. The existing accelerators also are not suitable for ultra-high power microwave drives, because the filling time for the acceleration cavity is too long for the length of the pulses that can be produced by modern pulse generators.

SUMMARY OF THE INVENTION

It is, therefore, an object of the present invention to provide an improved particle accelerator.

It is a further object of the invention to provide a particle accelerator having a high average field gradient for producing very high energy particles.

It is another object of the invention to provide a particle accelerator for high energy physics experiments, wherein a small number of very high energy particles are produced at very high field gradients or, alternatively, a large number of particles are produced at a lower field gradient.

New ideas and techniques for the development of high field gradient accelerators are of interest as a result of proposals to build the next generation of particle accelerators for high energy physics. In addition, any device which is capable of providing a high current or high acceleration gradient will have use in a wide variety of other applications. The present invention is directed to a high-electric field gradient accelerator which, in its simplest form, uses a very high power traveling electromagnetic wave propagating through a waveguide in the $TM_{02}$ mode of the guide. The electromagnetic wave is produced by one of the available high power microwave sources which use pulsed power technology to produce pulses having a duration of about 50–100 nsec. However, in order to provide the desired particle acceleration, it has been found necessary to provide, in accordance with the present invention, a cavity acceleration structure that provides a high group velocity so that the filling time is significantly reduced. This is accomplished by appropriate shaping of the waveguide cavity while retaining a smooth wall to prevent breakdowns and radiation losses, thereby allowing the group velocities of the waves to range between about 0.35–0.45 c, where c = the speed of light. This results in a filling time for the cavity of about an order of magnitude shorter than that available in existing accelerator cavities.

The shaping of the waveguide cavity also affects the acceleration of the electrons in the high field gradient accelerometer of the present invention. This shaping consists, in a preferred embodiment, of superimposing a periodic, sinusoidal form on an otherwise straight waveguide, or in another embodiment, of superimposing a periodic, helical form on the otherwise straight waveguide. Preferably, the waveguide is of a circular cross-section, with a smooth, internal wall surface which undulates in a sinusoidal or helical form with respect to the straight line axis of the structure. With this structure, continuous acceleration of the electrons along their direction of motion axially along the waveguide is produced with a significant reduction in radiation losses.

Continuous acceleration of the electrons is achieved in accordance with the present invention when the electrons slip two cycles of the RF electromagnetic wave in every period $\Gamma$ (see FIG. 1 or 4) of a circular waveguide structure. For a rectangular guide operated in the $TM_2$ mode, a phase slip of one cycle of the RF wave is required every period of the wave guide structure. Accordingly, unless explicitly stated otherwise, the following description will be directed to a cylindrical waveguide configuration. In such a cylindrical waveguide, when the electrons are centered in the waveguide, so that they travel axially along a straight line path through the waveguide cavity, maximum acceleration is accomplished by the central peak of the electromagnetic wave in the $TM_{02}$ mode when it coincides with the axis of the cavity; that is, where $r=0$, r being the radius of the circular waveguide. This occurs at the beginning of a period of the waveguide structure. A quarter period later in the waveguide structure, the undulation of the cavity sidewall brings the sidewall close to the straight-line axial path through the cavity, so that electrons following the axial path are close to the waveguide wall, and acceleration occurs as a result of electron interaction with the second radial peak of the electromagnetic wave. A quarter period later, the electrons will once again interact with the on-axis peak of the wave, and the electrons will have slipped one cycle of the RF wave. By allowing the electrons to slip two cycles of the RF wave every period $\Gamma$ of the structure as both the wave and the electrons propagate along the axis of the waveguide, the electrons are continuously accelerated throughout substantially the entire period of the structure, in the direction of their motion.

The field gradient may be further enhanced by producing a standing wave in the accelerator cavity, as by reflection of the electromagnetic wave from an iris downstream in the waveguide. The electric fields are then determined by the cavity quality factor and the ratio of the RF pulse direction to the cavity filling time. Further increases in the field gradient may be achieved by setting up $TM_{02n}$ modes in a closed oval, or "racetrack", cavity. The acceleration is accomplished in this latter case by imposing a helical or sinusoidal form on one or both of the long sides of the cavity.

Transverse focusing of the electron beam which is to be accelerated to keep it on the axis of the waveguide is not a problem in the structure of the present invention, since the radial accelerating field reverses in every cycle of the imposed electromagnetic field. It may be desirable, however, to superimpose some magnetic focusing lenses on the structure in order to improve the beam quality. Note that the electrostatic force tending to defocus the beam as a result of image charges will average out to zero for the symmetric undulating guide (shown in FIG. 4 to be described).

The high-field gradient accelerator of the invention thus operates on the principle of propagating an electron through a traveling $TM_{on}$ wave or a standing wave in the $TM_{Onp}$ mode of the waveguide, with the $TM_{02}$ $TM_{02p}$ modes being preferred. The guide includes an undulating interior surface which is curved in such a way that the electron, in passing through the guide in essentially a straight line path, samples all radial positions so that the particle is continuously accelerated throughout substantially the entire length of the structure. This structure and operation produces field gradients considerably in excess of gradients available with present-day state of the art accelerators which can produce about 20 MV/m, and in fact provides gradients in excess of 100 MV/m and as much as 300 MV/m at microwave frequencies of about 35 GHz.

The use of the $TM_{02}$ waveguide mode has the advantage not only of providing maximum acceleration at the center of a wave, but also allows the use of a relatively large waveguide for the operating frequency. This, in turn, allows the use of relatively high operating frequencies, in the range of 35 GHz, and reduces the fill time for the cavity. The development of a maximum field at the axis of the waveguide, and a corresponding reduction in the electric field at the waveguide wall, reduces the possibility of breakdown at the waveguide boundaries, reduces losses in the system, and allows the use of very high input power. The structure permits a reduction in or elimination of higher order cavity modes, which modes can lead to electron beam breakup at high currents as a result of the excitation of unwanted cavity modes. This permits the use of larger beam currents without serious instability.

In the present accelerator, low average current electron beams are accelerated to very high energies at gradients in excess of 100 MV/m or, by reducing the gradient, electron beams having a high average current, on the order of 100 amperes, can be accelerated by field gradients on the order of 10 MV/m. This lower gradient, high current accelerator may be used for a variety of applications, including the driving of free electron lasers. The electrons are accelerated in a straight trajectory along the axis of the waveguide by waves whose phase velocity is greater than the speed of light. These "fast waves" provide the necessary phase relationship with the electrons, and the transverse displacement of the peak of the wave with respect to the beam path, due to the undulating waveguide, provides the net cumulative interaction required for operation. This net cumulative interaction is made possible by the fact that the interaction of the electron beam is with the longitudinal, or axial, electric field component of the "fast wave", and the intensity of this field is a function of the radial location within the cavity; that is, at the beginning of a period the field is at a maximum at the axis and is zero at the walls and, in addition, passes through zero therebetween. Since the electrons are moving in a straight line, the large radiation losses of prior devices are eliminated, and there is no need for a guiding magnetic field to cause the electrons to move transversely as they travel along the axis in order to remain in the center of the cavity.

BRIEF DESCRIPTION OF THE DRAWINGS

The foregoing, and additional objects, features, and advantages of the present invention will become apparent to those of skill in the art from the following detailed description of preferred embodiments thereof, taken in conjunction with the accompanying drawings, in which:

FIG. 5 is a diagrammatic side view of a third embodiment of the waveguide system of FIG. 1;

FIG. 6 is a top view of the waveguide of FIG. 5;

FIG. 7 is a diagrammatic illustration of a $TM_{02}$ wave in a waveguide;

FIG. 8A is a diagrammatic illustration of the electric field felt by an electron due to a travelling $TM_{02}$ wave propagating along the length of a waveguide;

FIG. 8B is a diagrammatic illustration of the electric field felt by electrons in a standing wave produced in the cavity of FIG. 2; and FIG. 9 is a diagrammatic side elevation of a fourth embodiment of the waveguide system of FIG. 1.

DESCRIPTION OF PREFERRED EMBODIMENTS

Figure 1:
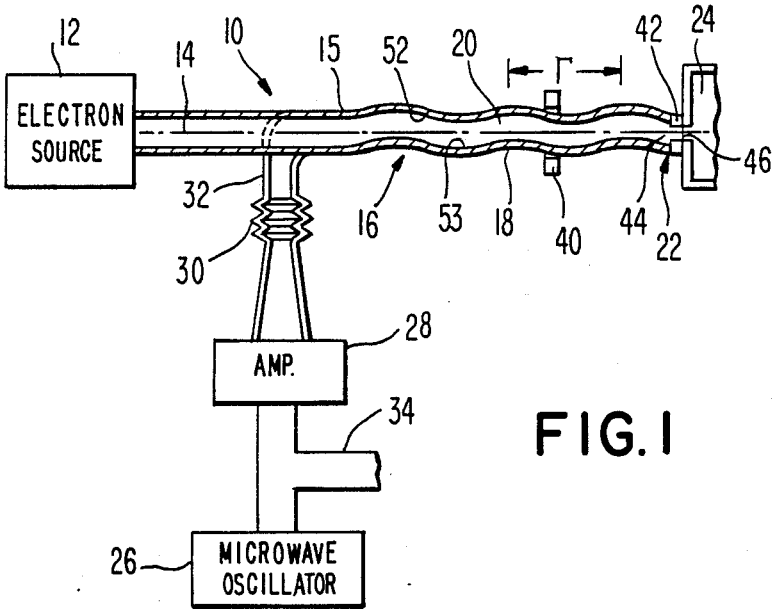
FIG. 1 is a diagrammatic side elevation in partial section of a preferred form of the accelerator system of the invention.

Turning now to a more detailed description of the present invention, there is illustrated in FIG. 1 a preferred form of a particle accelerator 10 wherein an electron gun 12 generates an intense, solid or annular relativistic beam 14 of electrons. The beam 14 is directed into the input end 15 of a waveguide section 16 having a circular cross-section and a smooth undulating wall 18 defining an accelerator structure 20. The beam travels longitudinally through section 16, along the straight line axis of the waveguide to the output end 22 of the waveguide section 16. The section 16 may be connected to a suitable load device 24, which for experimental purposes may be an energy spectrometer, or it may be connected to the input end of a second, similar waveguide section for further acceleration. The wall 18 is constructed of a conductive material such as copper, soft aluminum, or the like.

Microwave frequency electromagnetic energy is supplied to the waveguide 16 from a suitable source which may include, for example, a backward wave oscillator 26 which supplies microwave signals at a predetermined frequency through an amplifier 28. The amplifier may be connected through an adjustable bellows impedance matching section 30 and a curved waveguide connector section 32. The bellows section permits adjustment of the length of the waveguide section between amplifier 28 and the accelerator structure 20, to provide synchronization of the electromagnetic wave produced by source 26 and the electrons supplied to the cavity from the electron gun 12. The source 26 may provide 500 MV of power at a selected microwave frequency, which will propagate in a forward direction with positive phase velocity into the undulating waveguide section 16. The source 16 may also supply succeeding undulating accelerator structures (not shown) by way of a connector waveguide section 34.

Figure 2:
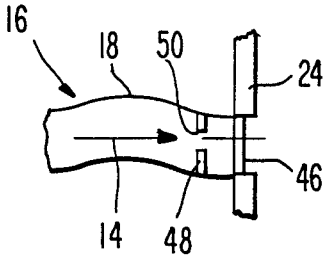
FIG. 2 is an enlarged diagrammatic view of a portion of the system of FIG. 1, showing a second embodiment of the invention.

Suitable deflecting magnets 40 are provided adjacent the path of the electron beam 14 for focusing the beam as may be required. The waveguide structure of the present invention may be tested by incorporating in the output end 22 of the waveguide 16 a suitable wave absorbent material 42 to prevent reflection of the microwave energy from source 26, when the device is operated in a traveling wave mode. The absorbent material 42 is formed with a central aperture 44 covered by a thin foil window 46 through which the beam 14 passes to transfer the high-energy accelerated electrons to the load 24. Alternatively, the device may be operated in a standing wave mode, in which case the electromagnetic wave absorbent material 42 is replaced by a reflective iris 48, shown in FIG. 2, which reflects a part of the impinging radiation to create standing waves in cavity 20. The central opening 50 of the iris allows the electron beam 14 to pass out of the cavity in known manner, through window 46.

Figure 3:
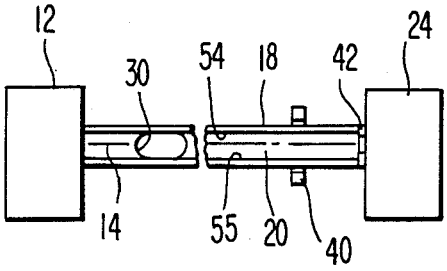
FIG. 3 is a top plan view in partial section of the systems of FIG.
Figure 4:
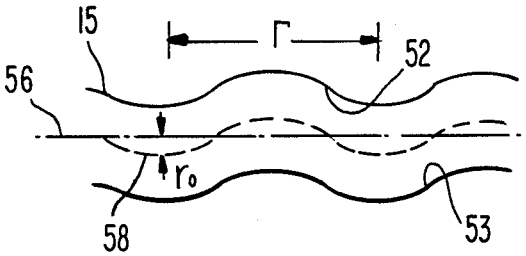
FIG. 4 is an enlarged partial view of the waveguide of FIG. 1.

The undulating waveguide 16, in one form of the invention, incorporates a smooth interior wall 18 which is circular in cross-section, and which varies sinusoidally along its length and with respect to its linear axis. This sinusoidal variation causes the upper and lower portions 52 and 53 of the wall to undulate in a first plane passing, for example, vertically through the axis of the waveguide, as illustrated in FIGS. 1 and 4, while the side wall portions 54 and 55 are linear in a second plane perpendicular to the first, as illustrated in FIG. 3. The longitudinal, linear axis of the waveguide is shown at 56 in FIG. 4, and this axis coincides with the linear path 14 of a particle passing through the waveguide. The upper and lower portions 52 and 53 of the sidewall lie in the first plane and are shown as varying sinusoidally and in phase with each other, following a sinusoidal wall axis 58 which varies about linear axis 56, as shown in FIG. 4. The undulation of the wall has a period $\Gamma$ and an amplitude $r_O$, also as illustrated in FIG. 4.

In a preferred form of the invention, illustrated in FIGS. 5 and 6, the undulating waveguide section, here shown at 60, has a wall 61 having a helical shape, so that the waveguide wall axis 62 follows a helical variation with respect to its normal, straight-line axis 64. Thus, as shown in the side view of FIG. 5, the wall axis 62 of the waveguide lying in, or projected on, a first plane, such as a vertical plane through axis 64 follows a sinusoidal pattern similar to that of the waveguide of FIG. 1. However, in a second plane perpendicular to the first, shown in FIG. 6, the waveguide wall axis 62, instead of being linear, also follows a sinusoidal pattern, although as shown in this view the pattern is 180° out of phase with the pattern of FIG. 5. In three dimensions, the wall axis 62 and thus the wall 61 follows a helical pattern about the linear axis 64 in a clockwise direction as viewed from the input end of the waveguide section.

The microwave source 26 produces microwave frequency pulsed signals of short pulse duration, typically 50–100 nsec., which are supplied to the undulating waveguide sections 16 or 60 in the $TM_{02}$ mode, which mode is illustrated in FIG. 7 by the curve 70, which shows the field intensity distribution across the diameter of the waveguide. As illustrated, the electric field which propagates along the waveguide section 16 has its peak value 72 at the axis of the structure, midway between the walls 18 of the waveguide, and has a zero value at the boundary walls. This reduces the possibility of breakdown at the waveguide boundaries, and allows the use of very high input power.

In the present accelerator, low average current beams may be accelerated to very high energies at gradients in excess of 100 MV/m or, by allowing a reduction in the achievable gradient, high average current beams, on the order of 100 amperes, can be accelerated at field gradients on the order of 10 MV/m. The low gradient, high current accelerator may be used for a variety of applications, including the driving of free electron lasers. Unlike prior linear accelerators, the electrons in the present device are accelerated by electromagnetic "fast waves" whose phase velocity is greater than the speed of light. There are two ways to achieve a cumulative net interaction between electrons and such waves. One is to let the "fast wave" continuously slip ahead of the synchronous electrons, and to have the electrons make a periodic transverse, or radial, displacement as they move along the waveguide. Although a periodic transverse motion of the electrons, together with their motion along the length of the waveguide, would provide the conditions for interaction; namely the correct phase relationship between the "fast wave" and the electrons (i.e., the synchronous condition), plus a transverse movement of the electrons to a stronger field during the time the field is in the favored direction along the length of the waveguide, and to a weaker electric field during the time the field is in the unfavored direction, this method of operation is unsatisfactory, for the periodic movement of the electrons from side to side within the waveguide required by this method results in undesired losses.

The second, and preferred, method for obtaining the desired interaction between the electrons and the accelerating waves is obtained in accordance with the invention by causing the electron beam to move in a straight trajectory along the axis of the waveguide. The "fast wave" of the electric field then undergoes a periodic transverse displacement with respect to the electron beam path as the wave follows the undulating walls of the waveguide, and the resulting periodicity of the "fast wave" trajectory provides the necessary phase relationship; that is, it provides synchronism between the electron beam and the field. The transverse displacement of the wave provides the required net cumulative interaction to cause acceleration of the beam. The net cumulative interaction is made possible by the fact that the interaction is with the longitudinal electric field component of the fast wave, and by the further fact that the intensity of the longitudinal electric field is a function of the radial position of the field with respect to the wave guide linear axis. With the $TM_{02}$ mode, this electric field is at a maximum at the axis of the waveguide and is zero at the walls.

The correct phase relationship between the fast wave and the electrons traveling along the path 14 in the accelerator of the present invention will be maintained if the time $t_e$ it takes the electron to travel one-half the periodic length of the waveguide is equal to the time $t_w$ it takes the electromagnetic wave to travel one periodic length plus one or more wavelengths, it being understood that the fast wave has a phase velocity which is higher than the speed of light and that the particles are drifting with a velocity approximately equal to the speed of light. This condition can be written in the following way:

$$t_e = h/V_e \tag{1}$$

where h is a synchronization length equal to one-half the periodic length of the undulating waveguide; and $V_e$ is the electron drift velocity.

$$t_w = (n\lambda_g + h)/v_p \tag{2}$$

where n is the number of wavelengths the fast wave slips ahead per period of the undulating waveguide, where n is equal to or greater than 2;

$\lambda_g$ is the wavelength of the fast wave in the waveguide; and $v_p$ is the phase velocity of the fast wave.

If the following substitutions are made:

$\lambda g = 2\pi/k_z$, and $v_p = \omega/k_z$ into equation (2) and equations (1) and (2) are solved for $\omega/c$, using the synchronism condition that $t_e = t_w$, this condition can be written as:

$$\omega/c = \frac{V_e}{c}\left(k_z + n\frac{2\pi}{h}\right) \tag{3}$$

where $k_z$ is the wave number of the wave in the longitudinal direction $\omega$ is the frequency of the fast wave in radian/sec; and c is the speed of light.

Or defining $k_p = 2\pi/h$ and taking n=1 (as this is the case of interest) the synchronism condition can be written as:

$$\omega/V_e = k_z + k_p \tag{4}$$

The wave number $k_z$ of the fast wave also has to satisfy the dispersion relation of the fast wave in the waveguide which is given by:

$$k^2 = k_z^2 + k_c^2 \tag{5}$$

where $k = \omega/c$ is the free space wave number of the wave; and $k_c = \omega_c/c$ is the cutoff wave number; and $\omega_c$ is the cutoff frequency.

Equation (4) describes a straight line on the $\omega$-k diagram of the wave with the slope given by the drift velocity of the electrons and its intercept with the $k_z = 0$ axis at $\omega = (-k_p)V_e$. Some of the important properties of the interaction between the fast-wave and the electrons are obtained by satisfying equations (4) and (5) simultaneously. Thus, solving for $k_z$ in terms of given parameters h, $k_c$, and $V_e<c$ the following is obtained:

$$k_z = \frac{k_p V_e \pm \sqrt{k_p^2 V_e^2 - (c^2 - V_e^2)(c^2 k_c^2 - k_p^2 V_e^2)}}{c^2 - V_e^2} \quad (6)$$

From equation (6) it is learned that the straight line given by equation (4) will intersect the ω-k diagram at two points. This means that for a given set of parameters there are two possible fast waves that will satisfy the synchronism condition. For the case when $ck_c > V_e k_p$, the value of kz will always be positive and for the two possible solutions the interaction is with a forward traveling wave. For the case when $ck_2 < V_e k_p$, the value of $k_z$ will be positive for one of the intersecting points and the synchronous wave is a forward traveling one. For the other intersecting point $k_z$ will be negative and the synchronous wave is a backward traveling relative to the electrons. For the case when $ck_c = V_e k_p$, there will be only one intersection point where the straight line is tangential to the ω-k curve on the positive side. For the case when $V_e = c$, solving for $k_z$ the following is obtained:

$$k_z = \frac{(k_c^2 - k_p^2)}{2k_p} \quad (7)$$

In this case for given parameters, h, ω, and a, the waveguide radius, there is only one possible synchronous wave. For the case when $k_c > k_p$, the synchronous wave is a forward traveling one. For the case when $k_c < k_p$, the synchronous wave is a backward traveling one. The case of interest is the one for which $V_e = c$ and the interaction is with a forward traveling wave. By substituting $k_c = P_{On}/a$ where $P_{On}$ are the zeros of the zero-order Bessel function, the condition for interacting with a forward traveling wave can be written as:

$$h/a > 6.28/P_{On} \quad (8)$$

which for a given $TM_{On}$ mode and waveguide radius will determine the minimum periodic length.

In the preceding section, we have considered a symmetrical undulating cylindrical waveguide. For a rectangular waveguide in the $TM_{21}$ mode, the quantity h becomes equal to the period of the undulator since the axial electric fields have an odd symmetry with respect to the waveguide axis.

As discussed above, one way to force the fast wave to travel in a periodic undulating trajectory relative to the electron path 14 is to use the smooth bore undulated waveguide 16 or 60 of FIGS. 1 and 5 where the period of the undulation is chosen so that it will satisfy the synchronism condition, and where the amplitude of the undulation $r_0$, which is always much smaller than the periodic length Γ, determines the net energy gain by the accelerated electrons. The preferred way to produce an undulation in a waveguide is to bend the waveguide symmetrically relative to the longitudinal axis 56, in the direction of the smooth guide, as can be seen in FIG. 4. In this configuration the wall axis 58 of the undulated waveguide varies as a function of the position along the waveguide as:

$$r(z) = r_0 \sin(2\pi z/\Gamma) \quad (9)$$

where Γ is the periodic length of the undulation and for a cylindrical waveguide is equal to 2 h. This configuration is preferred, since in this waveguide the wake defocusing field, which is due to the electron beam 14 having a varying position in relation to the tube walls, will alternate its direction in each periodic length.

In order for the interaction to be efficient the fast wave must be in one of the $TM_{On}$ modes. By inspection of the field distribution in the cross section of the waveguide for the different $TM_{On}$ modes, it can be seen that the most efficient interaction will be with the $TM_{02}$ mode, illustrated in FIG. 7, in which the longitudinal field component has two zeros along the radial direction, one at $r = 2.405/k_c$ indicated at crossover point 74 on reference line 76 in FIG. 7, and the other at the guide walls, where r=a. The fields along the radial direction r are divided into two regimes with respect to line 76, and in each one the field is in the opposite direction. By choosing the amplitude $r_0$ of the undulation of the waveguide so that $r_0 > 2.405/k_c$, one can obtain almost continuous acceleration. Assuming that the electrons are in the first regime $r < 2.405/k_c$ during the time the phase of the wave is between 0° to 90°, and is between 270° to 360°, and that the field accelerates the electrons, the electrons will be in the second regime during the time the phase of the wave is between 90° to 270° and once again the field will accelerate the electrons.

In the analysis of the relationship between the fast wave and the particles to be accelerated, the periodic bends in the waveguide will have four main effects:

1. When calculating the periodic length, a longer path for the wave is used than for the particles since the wave is forced to follow the undulating waveguide.

2. The wave is travelling with an angle X(z) relative to the particles and hence the projection of the field component on the particles path and not the fields themselves must be used.

3. The phase between the wave the particle, instead of changing continuously between 0 and 2π during the time the wave slips one wavelength ahead in each synchronous length, will have a small modulation. The phase can be written as:

$$\phi(z,t) = \phi_0(z,t) - \delta\phi \cos X(z) \quad (10)$$

where $\phi_0(z,t)$ would be the phase in a smooth waveguide. X(z) and δφ are functions of the undulation of the waveguide, i.e., the amplitude of the undulation and the periodic length. Since δφ is small angle, it can normally be ignored.

4. Since the beam has a varying position in relation to the undulating waveguide walls, a wake field will be present which will affect the beam emittance. This field will alternate in direction as the beam progresses through the device, and accordingly it can be ignored.

In the following analysis two sets of cylindrical coordinate systems are defined in the laboratory frame of reference. One is the coordinate system of the smooth waveguide which has its axis coinciding with the z axis. This is the coordinate system of the particles, where the particles are drifting along the z axis, shown in FIG. 1 as beam path 14. The second is the coordinate system of the undulating waveguide, in which the axis 58 of the waveguide is denoted by s. When reference is made to the wave field components in the undulating waveguide, a superscribed "w" is used to distinguish them from those in the smooth waveguide.

Using the rationalized M.K.S. units the real parts of the component fields for the $TM_{02}$ mode in a smooth circular waveguide are given by:

$$E_z(r,z) = E_o J_o(k_c r)\cos(\omega t - k_z z) \tag{11}$$

$$E_r(r,z) = -\frac{E_o k_z}{k_c} J_1(k_c r)\sin(\omega t - k_z z)$$

$$H_\phi(r,z) = -\frac{E_o k}{\eta_o k_c} J_1(k_c r)\sin(\omega t - k_z z)$$

where $E_o$ is the field on axis (V/M);

$J_o$, $J_l$ are the first kind Bessel functions of order zero and one; and $\eta_o$ is the intrinsic impedance of free space.

The field on axis is given by:

$$E_o = \left[\frac{2P\eta_o k_c^2}{\pi a^2 k k_z (J_1^2(k_c a) - J_o(k_c a)\cdot J_2(k_c a))}\right]^{\frac{1}{2}} \tag{12}$$

where P is the power flow in the waveguide (Watt) or by $$E_o = \left[\frac{2P\eta_o}{\pi a^2 (f/f_c)^2 \left(1 - \left(\frac{f_c}{f}\right)^2\right)^{\frac{1}{2}} (J_1^2(k_c a) - J_2(k_c a)\cdot J_2(k_c a))}\right]^{\frac{1}{2}} \tag{13}$$

where f, $f_c$ are the wave and the cutoff frequencies respectively.

There are two kinds of forces acting on the particle, the electric force $e\vec{E}$ and the magnetic force $e\vec{V}X\vec{B}$. The dynamic equation is given by:

$$\frac{d(P)}{dt} = e(E + VXB) \tag{14}$$

where $P = m\gamma\vec{V}$ is the relativistic momentum, m = Rest mass of the particle, $\gamma = (1-\beta^2)^{-\frac{1}{2}}$, $\beta = V/c$, and V is the drift velocity vector of the particle.

Taking the dot product of V with equation (14) and using the fact that $V \cong c$ we find that the relativistic particle energy changes according to $$\frac{d(\gamma mc^2)}{dt} = eV\cdot E \tag{15}$$

The perpendicular component of the equation of motion is given by $$\gamma m V_r + \gamma m V_r = e(E_r - V_z B_\theta) \tag{16}$$

where $V_z$ and $V_r$ are the longitudinal and the radial drift velocities, respectively, of the particle.

$B_\theta$ is the azimuthal magnetic field component.

The dot notation implies total time differentiation.

In the longitudinal direction, since the particle velocity is already very close to the speed of light, the particle will undergo a change only in its energy which is described by equation (15).

$$\vec{V} = \vec{V_z} + \vec{V_r}$$
now $V_r << V_z$
so $V \cong V_z$
and $\gamma(z) \cong \gamma_z(z)$.

Since also $E_r < E_z$ then $$\vec{V}\cdot\vec{E} \approx V_z E_z(z)$$

Since $V \cong c$ then the total time derivative is:

$$\frac{d}{dt} = \frac{d}{dz}\left(\frac{dz}{dt}\right) = c\frac{d}{dz}$$

Substituting in equation (15) then $$\frac{d\gamma(z)}{dz} = \frac{eV_z E_z(z)}{mc^3} \tag{17}$$

which describes the change of the particle energy as a function of position along the waveguide. Because of the curvature in the waveguide the wave is traveling with small angle X(z) relative to the particles. As a result of this the $E_z(z)$ field in equation (17) is not simply the 'axial' field of the wave given by equation (11). Rather it is given by the projection of the longitudinal and radial field of the wave along the particle trajectory. Using equation (9), the angle X(z) is given by $$X(z) = \tan^{-1}\frac{2\pi r_o}{\Gamma}\cos\left(\frac{2\pi z}{\Gamma}\right). \tag{18}$$

The magnitude of the angle X(z) is a function of the periodic length and the amplitude of the undulation. The field parallel to the particle trajectory is given by:

$$E_z(r,z) = \cos(X(z))\, E_z^w(r,z) + \sin(X(z)) E_r^w(r,z) \tag{19}$$

where $E_z^w(r,z)$ and $E_r^w(r,z)$ are the wave 'axial' and 'radial' field components of the wave in the undulating waveguide.

From the field distribution in the undulated waveguide and the sign of the slope of the guide axis it can be seen that the projection of the 'radial' field along the particle path is in the same direction as that of the axial field for half the period and in the opposite direction for the other half. Therefore its contribution to the energy gain by the particle traversing one undulator period is almost zero, hence this term can be neglected. Since the average value of cos X(z) is close to one, to very good approximation the axial field given by the right side of equation (19) is equal to the 'axial' field of the wave. Employing equation (9) and the synchronism condition, neglecting the small effect of the undulation on the synchronism length, to express the temporal variation in the field as a function of position, the field felt by the particles on axis is:

$$E_z(r,z) \cong E_o J_o\left(k_c r_0 \sin\left(\frac{2\pi z}{\Gamma}\right)\right)\cos\left(\frac{4\pi z}{\Gamma} + \phi\right) \tag{20}$$

where $\phi$ is the phase angle between the wave crest and the particles at $z=0$.

Waveform 78 in FIG. 8A is a diagrammatic illustration of the field described by Equation 20, and felt by a particle traversing the cavity.

Since $V_z \cong c$ the change of the particle energy along the accelerator is given by:

$$\frac{d\gamma(z)}{dz} = \frac{eE_o}{mc^2} J_o\left(k_c r_0 \sin\left(\frac{2\pi z}{\Gamma}\right)\right)\cos\left(\frac{4\pi z}{\Gamma} + \phi\right) \tag{21}$$

From which it is found that the rate of increase of the energy of the particle is independent of the particle energy, and that the phase $\phi$ of the synchronous particle has to be equal to zero.

The electric field on axis and the average field gradient achievable with propagation in the $TM_{On}$ mode increases rapidly as the wave frequency approaches the cutoff frequency. A useful limit on this ratio is determined by the reduction in the wave group velocity, and the increase in the wave attenuation.

The equation of the transverse motion of the particle is given by equation (16). To take into account the effect of the curvature of the guide on the transverse motion, equation (16) has to be modified to include the projection of the fields component along the transverse direction in the particle coordinate system. The transverse motion of the particles is described by:

$$\ddot{r}m\dot{\gamma} + \gamma m V_r = e[\cos X(z)\, E_r^w - V_z B_\theta^w + \sin X(z)\, E_z^w] \tag{22}$$

where $E_z^w$, $E_r^w$, $B_\theta^w$ are the wave fields components in the undulating waveguide.

Substituting from equation (17) the expression for $\dot{\gamma}$ into the second term on the left side of equation (22) then:

$$\dot{\gamma} m V_r = \frac{eV_r V_z E_z^w}{c^2} = \frac{eE_z^w V_r}{c} \tag{23}$$

Substituting equation (23) into (22) then:

$$\ddot{r}m = e\left[\cos X(z)(E_r^w - V_r B_\theta^w) + \sin X(z)\, E_z^w - \frac{E_z^w V_r}{c}\right] \tag{24}$$

Now $V_r/c << 1$ and it will become even smaller as the energy of the particle increases, so that the third term on the right side is at least one order of magnitude smaller than the other terms and hence can be neglected to simplify the analysis. Using this approximation the radial force is given by the left side of equation (24). Using the following equalities $$B_\theta = \mu_o H$$

$$\eta_o = \sqrt{\mu_o/\epsilon_o}$$

$$k_z/k_c = 1/[(v_p/c)^2 - 1]^{\frac{1}{2}}$$

$$k/ck_c = v_p/c\,[(v/p/c)^2 - 1]^{\frac{1}{2}}$$

where $\mu_o$ is the permeability, and $\epsilon_o$ is the permitivity, the transverse wave fields components can be written in the following way:

$$E_r^w(z,r,t) = -\frac{E_o J_1\left(k_c r_o \sin\left(\frac{2\pi z}{\Gamma}\right)\right)}{\left[\left(\frac{v_p}{c}\right)^2 - 1\right]^{\frac{1}{2}}} \sin(\omega t - k_z z + \phi) \tag{25}$$

and $$B_\theta^w(z,r,t) = -\frac{V_p E_o J_1\left(k_c r_o \sin\left(\frac{2\pi z}{\Gamma}\right)\right)}{c^2\left[\left(\frac{v_p}{c}\right)^2 - 1\right]^{\frac{1}{2}}} \sin(\omega t - k_z z + \phi) \tag{26}$$

In the expressions for the traverse fields the correct phase angle should have been written as $(\omega t - (\vec{k_z})_s \cdot z + \phi)$, where $(\vec{k_z})_s$ is the longitudinal wave vector in the undulating waveguide. By using the simplified expression $(\omega t - k_z z + \phi)$ a small phase modulation is neglected.

Substituting these expressions into (24) the radial force acting on particles on axis is given by:

$$F_r(z,t) = eE_o\left[\frac{\cos X(z)\, gJ_1\left(k_c r_o \sin\left(\frac{2\pi z}{\Gamma}\right)\right)\sin(\omega t - k_z z + \phi)\left(\frac{V_e v_P}{c^2} - 1\right)}{\left[\left(\frac{v_p}{c}\right)^2 - 1\right]^{\frac{1}{2}}} + \sin X(z) J_o\left(k_c r_o \sin\left(\frac{2\pi z}{\Gamma}\right)\right)\cos(\omega t - k_z z + \phi)\right] \tag{27}$$

where $g = -1$.

The first term on the right side of equation (27) is the radial force due to the traverse fields component of the wave. The $E_r$ and $\vec{V_z} \times \vec{B_\theta}$ terms tend to cancel each other, but since the phase velocity of the wave is greater than the speed of light and because the particle is moving almost at the speed of light, the magnetic field force is the dominant one as $V_e v_p/c^2 > 1$. This is in spite of the fact that as the phase velocity becomes smaller the transverse fields become stronger and the radial force stays about the same because of the cancellation. The second term on the right, which came from the projection of the longitudinal field component of the wave in the radial direction, can't be neglected compared to the first term. The radial velocity and displacement are inversely proportional to the particle energy, and will become smaller as the particle traverses the accelerator. The factor g enters because, in the first half of the period the particle is below the axis of the undulating waveguide. Therefore the radial force due to the transverse fields is in the negative radial direction. In the second half as the argument of the Bessel function becomes negative while the particle is above the axis, it is needed to compensate the minus sign that enters because $J_1(k_c r)$ is an odd function. The radial force, given by equation (27), can be written in the following way:

$$F_r(z,t)=eE_oF(f, f/f_c, r_o/a, t,z) \tag{28}$$

where the function $F(f, f/f_c, r_o/a, t, z)$ describes the oscillatory behavior of the radial force. The function $F(f, f/f_c, r_o/a, t, z)$ is periodic in z, and it satisfies the periodicity condition $F(f, f/f_c, r_o/a, t, z)=F(f, f/f_c, r_o/a,t,z+r)$. From equation (27) it can be seen that the function $F(f, f/f_c, r_o/a, t, z)$ can be written $$F(f, f/f_c, r_o/a, t, z) = F_1(f, f/f_c, r_o/a, t, z) + F_2(f, f/f_c, r_o/a, t, z) \tag{29}$$

where $F_1(f, f/f_c, r_o/a, t, z)$ describes the radial force due to the transverse fields component, and $F_2(f, f/f_c, r_o/a, t, z)$ describes the radial force due to the projection of the longitudinal field along the radial direction. The function $F_2(f, f/f_c, r_o/a, t, z)$ has large values at $z=0$, $r/2$, and r since at this point the acceleration field is maximum and also the slope of the local guide to the z axis is maximum. The radial force causes the particle to move outward, during the time it traverses the first half of the period, and inward while it traverses the second half. For a particle on axis, neglecting the small effect of the difference in the particle energy in the two halves, the force in the first half is equal to that in the second half, hence at the end of the period the particle will be once again on axis. Since the radial force depends on the radial position, for particles off axis the situation is somewhat more complicated. For example, for a particle located above the axis, in the first half its radial position relative to the axis of the undulating waveguide will be smaller than in the second half, therefore it will feel a different radial force in each half. This radial dependence might lead to a small radial debunching.

The radial velocity and the radial displacement, not taking into account the wake field, can be calculated by integrating equation (27).

The preceding analysis relates to the acceleration of a particle in a traveling wave. The same principles may be extended to include acceleration in a standing wave where the guide is a part of a cavity having length L which typically is much greater than the periodicity length r. The results described above may be carried over almost directly to the analysis of the cavity mode since the standing wave can be decomposed into two oppositely directed traveling waves, with the particle being accelerated in the forward traveling wave. In the following analysis however, the particle acceleration is obtained directly from the field distribution of a standing wave in the guide.

Using rationalized M.K.S. units the real parts of the field components of a $TM_{omp}$ mode in a smooth circular guide are given by $$E_z(r,z,t) = E_{ax}J_o(k_c r)\cos\left(\frac{\pi pz}{L}\right)\cos\omega t \tag{30}$$

$$E_r(r,z,t) = E_{ax}\frac{k_z}{k_c}J_1(k_c r)\sin\left(\frac{\pi pz}{L}\right)\cos\omega t$$

-continued $$H_\theta(r,z,t) = -E_{ax}\frac{k}{k_c\eta_o}J_1(k_c r)\cos\left(\frac{\pi pz}{L}\right)\sin\omega t$$

where $k_z=\pi p/L$, and p is the cavity length measured in half wavelengths. The resonant frequency of the cavity in the $TM_{o2p}$ mode is given by:

$$f_R = c\left[\left(\frac{P}{2L}\right)^2 + \left(\frac{5.52}{2\pi a}\right)^2\right]^{\frac{1}{2}} \tag{31}$$

The maximum obtainable field on axis, $E_{ax}$, is calculated by equating the power losses in the walls to the input power to the cavity. If the cavity length is much greater than its radius, so the losses in the end plates can be neglected, then for a copper guide the considerably simplified result is obtained:

$$E_{ax} = \left[\frac{2.43\times 10^{15}\times P_{in}\times f_c^{3/2}\times\left(\frac{f_c}{f}\right)^{3/2}\times\left(1-\left(\frac{f_c}{f}\right)\right)^{2\frac{1}{2}}}{P}\right]^{\frac{1}{2}} \tag{32}$$

where $P_{in}$=the power input in MW, and $f_c$=the cut-off frequency in GHz.

The synchronism condition for the particle to be continuously accelerated in the standing wave is identical to that given by equation (4) for the traveling wave with the wave number $k_z=p/L$ now determined by the resonant frequency of the cavity and the cutoff frequency in the open guide. It is instructive to express this in the alternate form $$\Gamma = \frac{2\lambda_g\beta_e}{\beta_p-\beta_e} \tag{33}$$

where $\lambda g$ is the guide wavelength, and $\beta_e$, $\beta_p$ are the particle and the wave phase normalized velocities respectively.

In obtaining this expression the effect of the cavity boundary undulation on the wave characteristics is neglected. Since the wave phase velocity exceeds the speed of light there is no critical tuning of the undulation wavelength to satisfy the synchronism condition as the electron energy is increased.

The change in the particle energy as a function of position is described by equation (17). For the same reasons as in the case of a traveling wave, the field felt by the particle in the longitudinal direction is approximated by the 'axial' field of the standing wave given by equation (30). Using the synchronism condition to express the wave frequency in terms of spatial parameters, then:

$$E_z(z) = E_{ax}J_o\left(k_c r_o\sin\left(\frac{2\pi z}{\Gamma}\right)\right)\cos\left(\frac{\pi pz}{L}\right)\cos(k_z+k_p)z \tag{34}$$

Substituting in equation (21) then:

$$\frac{d\gamma(z)}{dz} = \frac{eE_{ax}}{mc^2} J_o\left(k_c r_o \sin\left(\frac{2\pi z}{\Gamma}\right)\right)\cos\left(\frac{\pi p z}{L}\right)\cos(k_z + k_p)z \tag{35}$$

The local acceleration field felt by the particle in traversing the cavity is shown by the waveform 80 in FIG. 8B for the case when $f/f_c=1.061$ for which $r=\lambda g$. The waveguide cavity is assumed to be an integral number of undulation periods in length, a criterion which maximizes the energy gain of the particle. The acceleration field for the case when $f/f_c=1.666$ is only one third of that obtained when $f/f_c=1.061$. The average acceleration field which can be obtained in the cavity case is approximately the same as that found in the traveling wave case for constant frequency operation, but the source power requirement is approximately an order of magnitude lower. The phase coherence of the waves generated by the high power sources will be improved by the use of a cavity. Also, in the cavity mode, conversion from $TM_{02}$ cannot affect operation. The use of a power compression technique to fill the cavity will also result, if needed, in higher power drive capabilities.

A variant on the cavity structure illustrated in the foregoing figures is the travelling wave resonator 90 illustrated in FIG. 9. This so-called "race track" configuration gives the advantages of a travelling wave device, yet retains the desirable features of the cavity mode of operation. In the race track configuration, a single wave circulates around the closed waveguide 92, with the resonance condition required for the cavity mode of operation being set by the cavity length being an integral number of wavelengths. In this configuration, the microwave generator 26 supplies electromagnetic waves by way of the input wave guide section 94 and the tuning bellows 96, the wave then entering the closed guide 92 and traveling along an undulating portion 98 where the electrons from electron gun 12 are accelerated in the manner described above. The electrons travel along path 14, as previously described, and are accelerated as they travel through the undulating section 98, also as previously described. The electrons exit from the closed waveguide 92 at section 100, and are directed into the load device 24, again as previously described. In this configuration, the ratio of the acceleration field to the axial field is identical to that found for the travelling wave case.

Returning to the analysis of the interaction between the particles being accelerated and the applied field, in the standing wave mode, the motion of the particle in a transverse direction in a TM mode is given by equation 24, above. Substituting the transverse field components and synchronism condition to express the frequency in terms of the spatial parameters, and by integrating the resulting equations, the transverse velocity and displacement can be obtained. It is found that these results are higher than those obtained for a travelling wave accelerator since, in the standing wave accelerator, the field on axis is higher by about 50 percent.

The longitudinal motion of the particles in the cavity is described by equation 17 which is independent of the radial velocity; accordingly, it is possible to analyze the longitudinal part of the particle motion and energy gain without dealing with the transverse motion. This simplification is based on the restriction that the radial velocity is much smaller than the longitudinal velocity, a restriction that is well satisfied about one or two meters from the input to the accelerator. The longitudinal motion of the particles can be described in non-dimensional units which then permit a description of the particle motion in Hamiltonian form, and from this can be derived the phase oscillation.

A set of dimensionless parameters using the periodic length $\Gamma$ of the undulating waveguide as the normalizing unit length can be defined as follows:

$\xi=z/\Gamma$, axial distance in unit of the periodic length, $\eta=r/\Gamma$, radial distance in unit of the periodic length, $\tau=\nu t$, time in number of cycles, $\nu=\beta_e c/\Gamma$, normalized frequency, $\alpha=eE\Gamma/m_o c^2$, maximum energy which a traveling wave with an average field amplitude of E can give to a particle traversing one periodic length $\Gamma$ divided by the particle rest energy, $\beta_p=v_p/c$, phase velocity of the wave divided by the velocity of light, $\beta_e=V_e/c$, velocity of the particles divided by the velocity of light, $\gamma$, mass of the particle in unit of the particle rest mass, $\phi$, phase of the particle in number of cycles with respect to the crest of the traveling wave.

The longitudinal accelerating field is given by $$E_z(r,z) = E_o J_o\left(k_c r \sin\left(\frac{2\pi z}{\Gamma}\right)\right)\cos(\omega t - k_z z + \phi) \tag{36}$$

Since only the small oscillation of the phase angle around the phase angle of the synchronous particle $\phi_s=0$ is of interest, then:

$$\cos(\omega t - k_z z + \phi) \approx \cos(\omega t - k_z z)\cos\phi \tag{37}$$

where we neglect the second term $\sin\phi << \cos\phi$. Using equation (36) and equation (37) the average acceleration field per periodic length can be written as $$\langle E_z \rangle_\Gamma = \overline{E}\cos\phi \tag{38}$$

where $$E = \frac{E_o}{\Gamma}\int_o^\Gamma J_o\left(k_c r_o \sin\left(\frac{2\pi z}{\Gamma}\right)\right)\cos(\omega t - k_z z)dz \tag{39}$$

Using the above definitions, the longitudinal equation of motion (17) in dimensionless form can be written as:

$$\frac{d\gamma}{d\xi} = \alpha\cos(2\pi\phi) \tag{40}$$

and $$\frac{d\tau}{d\xi} = 1/\beta_e = \pm\frac{\gamma}{(\gamma^2 - 1)^{\frac{1}{2}}} \tag{41}$$

and the equation of the phase angle can be written as $$\frac{d\phi}{d\xi} = \frac{(\beta_p - \beta_p^o) - (\beta_e - \beta_e^o)}{\beta_e^o}\,\frac{\Gamma}{\lambda_g} \tag{42}$$

where $\lambda_g$ is the waveguide wavelength, and $\beta_p$ and $\beta_e$ are the phase and the drifted normalized velocities of the synchronous particle respectively. $\beta_p^o$ and $\beta_e^o$ are the initial phase velocity of the synchronous wave and the drift velocity of the synchronous particle respectively.

As can be seen from the equation of motion of the phase angle (42), a change in the phase angle is caused by a change in either the phase velocity of the wave, or the drift velocity of the particle, or both of them. In order to be able to solve the phase angle motion analytically it can be divided into two simplified cases where each one of them is applicable to different parts of the accelerator. In the first case it is assumed that the phase velocity of the wave is constant and the drift velocity of the particles is approximately equal to the speed of light and the phase velocity of the wave is modulated. In both cases it is assumed that $\alpha$ is constant. The first case is applicable to the beginning of the accelerator where the velocity of the particles is still changing a few percent per periodic length; a change of 1 percent of the drift velocity causes a shift of 3.6 degrees per period length in the phase angle. The other case is applicable to the main part of the accelerator where the particle energy is high and the drift velocity is almost independent of the particle energy and can be taken nearly as a constant. This simplifying assumption is very well satisfied for most of the accelerator length. On the other hand, in the first case, the assumption that the phase velocity is constant is not true since the phase velocity of the wave is modulated and hence will change. For this case the assumption is that the change in the phase angle is mainly determined by the change in the drift velocity of the particles. (For the cases when the phase velocity $_p=3$ the phase angle will change twice as much for a change in the drift velocity as it would due to the same change in the phase velocity.) For the cases when this assumption is not fulfilled the equation of motion of the phase angle must be solved numerically taking into account the change in both velocities.

For the first case then, it is assumed that $\beta_p$=constant and $\alpha$=constant, and that $\delta\beta_e/\beta_e << 1$. The equation of the phase angle is given by $$\frac{d\phi}{d\xi} = -\frac{(\xi - \xi_0)}{\xi^2}\frac{\Gamma}{\lambda_g} \tag{43}$$

where $$\xi_0 = (\gamma_0^2 - 1)^{\frac{1}{2}}/\gamma_0 = \beta_e^o$$

Using equations (40) and (41), equation (43) can be written as $$\frac{(\gamma_0^2 - 1)^{\frac{1}{2}}\gamma^2 d\gamma}{\gamma_0(\gamma^2 - 1)} - \frac{\gamma d\gamma}{(\gamma^2 - 1)^{\frac{1}{2}}} = \alpha\cos(2\pi\phi)d\phi \tag{44}$$

Integrating both sides, then:

$$\frac{(\gamma_0^2 - 1)^{\frac{1}{2}}}{\gamma_0}\left[\gamma + 0.5\log\left(\frac{\gamma + 1}{\gamma - 1}\right)\right]\frac{\Gamma}{\lambda_g} - (\gamma^2 - 1)^{\frac{1}{2}}\frac{\Gamma}{\lambda_g} - \frac{\alpha}{2\pi}\sin(2\pi\phi) = H \tag{45}$$

where H is a constant determined by the initial condition of $\phi$ and $\beta_e$. Since in this case $\gamma > 1$ so $\gamma >> 0.5 \log(\gamma + 1/\gamma - 1)$ and equation (45) can be written as $$\frac{(\gamma_0^2 - 1)^{\frac{1}{2}}}{\gamma_0}\frac{\Gamma\gamma}{\lambda_g} - \frac{(\gamma^2 - 1)^{\frac{1}{2}}\Gamma}{\lambda_g} - \frac{\alpha}{2\pi}\sin(2\pi\phi) = H \tag{46}$$

H may be considered as the Hamiltonian in dimensionless units for the longitudinal motion; thus, if by denoting $(\gamma^2 - 1)^{\frac{1}{2}} - \beta_e\gamma = q$ equation 46 can be written as:

$$\frac{(\gamma_0^2 - 1)^{\frac{1}{2}}\Gamma(q^2 + 1)^{\frac{1}{2}}}{\gamma_0\lambda_g} - q\frac{\Gamma}{\lambda_g} - \frac{\alpha}{2\pi}\sin(2\pi\phi) = H \tag{47}$$

from which the first Hamiltonian equation of motion $$\frac{\partial H}{\partial\phi} = \frac{\partial q}{\partial\tau}$$

is derived using the following approximations:

1.

$$\frac{\partial^2\xi}{\partial\tau^2} \simeq 0$$

as $\beta_e$ is changing very slowly.

2. $\beta_e \cong 1$.

Both of these assumptions are justified as this invention deals with relativistic particles.

In the second case, it is assumed that $\beta_e$ is approximately equal to the speed of light ($\beta_e$ is not taken as constant), $\alpha$ is constant, and $$\beta_p = \beta_p^0\left(1 + \epsilon\cos\left(\frac{4\pi z}{\Gamma}\right)\right) \text{where } \epsilon << 1. \tag{48}$$

Using this assumption equation (42) can be written as $$\frac{d\phi}{d\xi} = \frac{\Gamma\beta_p^0\epsilon}{\lambda_g\beta_e^{02}}\cos\left(\frac{4\pi z}{\Gamma}\right) - \frac{\Gamma}{\lambda_g\beta_e^2}(\beta_e - \beta_e^0) \tag{49}$$

Once again substituting equations (40) and (41) into (49) the following is obtained:

$$\frac{\Gamma\beta_p^0\epsilon}{\lambda_g\beta_e^{02}}\cos\left(\frac{4\pi z}{\Gamma}\right) + \frac{\Gamma}{\lambda_g\beta_e^0}d\gamma - \frac{\Gamma}{\lambda_g\beta_e}d\gamma = \alpha\cos(2\pi\phi)d\phi \tag{50}$$

Integrating both sides:

$$\frac{\Gamma\beta_p^0\epsilon}{\lambda_g\beta_e^{02}}\cos\left(\frac{4\pi z}{\Gamma}\right)\gamma + \frac{\Gamma\gamma}{\lambda_g\beta_e^0} - \frac{\Gamma}{\lambda_g}(\gamma^2 - 1)^{\frac{1}{2}} - \frac{\alpha}{2\pi}\sin(2\pi\phi) = H \tag{51}$$

Substituting the quantity q into equation (51) the dimensionless Hamiltonian is obtained:

$$\frac{\Gamma\beta_p^0\epsilon}{\lambda_g\beta_e^{02}}\cos\left(\frac{4\pi z}{\Gamma}\right) + \tag{52}$$

-continued $$\frac{\Gamma}{\lambda_g \beta_e^0}(q^2+1)^{\frac{1}{2}} - \frac{\Gamma}{\lambda_g} q - \frac{\alpha}{2\pi}\sin(2\pi\phi) = H$$

The Hamiltonian equations of motion can be obtained from (52). It can be seen from (52) that, as H is constant the change in the phase angle must follow the oscillation of the phase velocity. Various pieces of information about the particle motion may be obtained from a q-o plot, i.e., a phase diagram, with H as a parameter.

During the time that the particle drift velocity is still changing with its energy (first case) the change in velocity will cause a change in position which will cause a change in the phase angle. On the other hand, a change in phase angle will cause a change in the acquired energy which is followed by a change in the drift velocity and hence a change in position. This closed loop feedback mechanism causes the particles to oscillate with an amplitude that will become smaller as the particles energy increases. By choosing the synchronous phase angle to be about $\phi_s=10°$ the oscillatory motion of the particles will bunch them around the synchronous angle $\phi_s$. The bunching mechanism can be viewed as follows: a particle that is moving faster than the synchronous particle with $\phi=\phi_s$ will have a larger phase angle and hence will acquire less energy from the wave, so it will move once again to a smaller phase angle. On the other hand, a particle that is moving slower than the synchronous particle will have a smaller phase angle so it will acquire more energy from the wave and move to a position where it will have larger phase angle. During this phase of acceleration, the transverse oscillatory motion of the particles also causes bunching, but this time the bunching is in the radial direction as well as in the longitudinal direction, since the energy gain from the wave is a function of the particle radial position, and the transverse force is inversely proportional to the particle energy.

At the point along the accelerator where the energy of the particle becomes large enough that its drift velocity is almost independent of its energy, the above described bunching mechanism will not be effective anymore. On the other hand, from this point to the end of the accelerator the the phase velocity modulation which is followed by phase angle oscillation has an important effect on the energy spread of the particles in the bunch at the output of the accelerator. This effect can be explained as follows: In this part of the accelerator the phase angle of the synchronous particle should be $\phi_s=0$ and the energy acquired by the particles is symmetric around $\phi_s=0$. Hence the energy of the particles in a bunch that is located within the amplitude of the phase angle oscillation around the phase angle of the synchronous particle will be 'averaged' by the phase angle oscillation. If the accelerator length is much greater than one periodic length the 'averaging' will occur many times, since the phase angle sweeps through the bunch once in each periodic length. The 'averaging' mechanism is independent of the particle energy so it will continue up to the end of the accelerator. Thus, for a long accelerator, the net effect is that the spread in energy within the bunch will be much smaller at the output than at the input to the accelerator.

The accelerator of the present invention can be operated with a wide range of frequencies, power levels, and different modes. Therefore, in order to achieve an optimal design these three parameters must be optimized according to the use of the accelerator and the r.f. sources available.

The acceleration field is determined by the strength of the electric field on axis which for a traveling wave in a $TM_{02}$ mode can be written as $$E_z = \frac{52.1(P_{in})^{\frac{1}{2}} f(f_c/f)^3}{C(1-(f_c/f)^2)^{\frac{1}{2}}} \tag{53}$$

where $p_{in}$ is the input power in watts, and f the operating frequency in Hz.

An important feature illustrated by equation (53) is that the field on the axis of the waveguide varies proportionally with the wave frequency and only as a square-root of the wave power. Therefore, a high field gradient, low current accelerator has to be designed to operate at the highest possible frequency, with the wave frequency as close as possible to the cutoff frequency. The accelerating field increases rapidly as the ratio between it and the cutoff frequency approaches one. On the other hand a low field gradient, high current accelerator should be operated at much lower frequency but at the highest possible power level.

The upper limit on the input power is imposed by breakdown at guide boundaries caused by the radial electric field which at the guide walls is at least one order of magnitude smaller than the field on axis. Because of this, the accelerator can be operated at much higher input power than is possible with prior linear accelerators.

The upper limit on the frequency is given by the condition that the beam radial extent will be much smaller than half the waveguide radius.

The limit on $f/f_c$ is imposed by the wall losses which increase rapidly as the wave frequency approaches the cutoff frequency. For a given operating frequency a practical limit on the phase velocity value is set by the reduction in the group velocity and the increase in the guide losses. The waveguide diameter is determined by the wave frequency and the value of $f/f_c$.

The range of possible operating frequencies and power levels extend from a few GHz up to 35 GHz and higher and from tens of MW up to tens of GW. This wide range of operating parameters is possible because of the unique features of the accelerator waveguide. One of the main features is the use of a higher mode, $TM_{02}$, to accelerate the particles in an overmoded guide so high frequencies can be used relatively easily. Another important feature is the absence of any internal disk structure, which is the main limitation on the possible operating frequencies and power levels in prior linear accelerators. A still further feature is that the accelerator can be operated with a group velocity ranging from 0.66c–0.33c which will make it possible to utilize new pulse power technology to accelerate the particles even with R.F. power sources that have a very short pulse duration. Such short pulse sources can be used in linear accelerators only if the power is fed in at very short intervals to compensate for the very low value of the group velocity found in conventional slow wave structures.

These unique characteristics give the designer a wide range of parameters to choose from according to the needed accelerator and the R.F. power sources available to him. In Table I are summarized the design parameters for three different high energy 100 MV/m low current accelerators operating at different frequencies and modes. In deriving the parameters in the table it is assumed that the wave power is 1 GW. The operating frequency is taken to be 1.06 times the cutoff frequency which determines a group velocity of 0.33c, and the efficiency, which is determined by the ratio between the stored energy in the accelerator and that which is used for acceleration, is assumed to be ten percent.

TABLE I

Operating Parameters for a High-Energy Accelerator

| | $TM_{02}$ TRAVELING WAVE | $TM_{02}$ CAVITY MODE | $TM_{02}$ TRAVELING WAVE RESONATOR |
|---|---|---|---|
| Frequency (GHz) | 35 | 12.5 | 12.5 |
| Power (GW) | 1 | 1 | 1 |
| Pulse Width (nsec) | 50 | 90 | 90 |
| Field on Axis (MV/m) | 310 | 450 | 320 |
| Acceleration Field (MV/m) | 100 | 100 | 100 |
| Undulator Period (cm) | 2.8 | 7.2 | 7.2 |
| Wall Modulation | 0.6 | 0.6 | 0.6 |
| Number of Bunches/Pulse | 390 | 200 | 200 |
| Number of Particles/Bunch | $1.6 \times 10^8$ | $2.5 \times 10^9$ | $2.5 \times 10^9$ |
| Synchrotron Radiation Energy Loss (MeV/m) at 100 GeV | 0.8 | 1.5 | 0.8 |
| Shunt Impedance (MΩ/m) | 107 | 60 | 60 |
| Unloaded Q (l/m) | | $3.7 \times 10^4$ | $3.7 \times 10^4$ |
| Elastance S | $10^{15}$ | $1.0 \times 10^{14}$ | $2.3 \times 10^{14}$ |

In the first column is shown the parameters for a traveling wave mode accelerator. The operating frequency is taken to be 35 GHz and the pulse width is 50 nsec. The length of the accelerator module per rf source is 3 meters. Since the particle velocity is approximately three times higher than the group velocity of the wave, only the last 30 nsec. can be used for acceleration. The accelerated beam consists of closely spaced bunches 2.8 cm. apart. The total energy available for acceleration per pulse is about 3 Joules.

In the second and third columns is shown the typical parameters for operating in a cavity mode and traveling wave resonator mode, respectively. The operating frequency is taken to be 12.5 GHz and the pulse width 90 nsec. The length of the cavity is one meter. In order to build up the desired acceleration field of 100 MV/m, the cavity is pumped in both cases for about one tenth of the filling time $2Q/\omega$ at the specified power level. The stored energy in the cavity will decay to ninety percent of its initial value, due to wall losses, in about 50 nsec. Using this time period for acceleration produces 200 bunches per pulse. The available energy for acceleration is 9 Joules, from which is obtained the number of particles per bunch of $2.5 \times 10^8$.

In Table II are summarized possible operating conditions for a low-energy 10 MV/m high current bunched bean accelerator, for use for example, in an FEL. In this case, as explained before, the operating frequency (5.7 GHz) is lower.

This case, as was true in the earlier examples, has not been optimized.

TABLE II

Operating Parameters for a High Current Accelerator

| | $TM_{02}$ TRAVELING WAVE | $TM_{02}$ TRAVELING WAVE RESONATOR |
|---|---|---|
| Frequency (GHz) | 5.7 | 5.7 |
| Power (MW) | 1000 | 250 |
| Pulse Width (nsec) | 50 | 100 |
| Field on Axis (MV/m) | 50 | 50 |
| Acceleration Field (MV/m) | 10 | 10 |
| Undulator Period (cm) | 16 | 16 |
| Wall Modulation | 0.3 | 0.3 |
| Number of Bunches/Pulse | 85 | 94 |
| Number of Particles/Bunch | $7 \times 10^9$ | $9 \times 10^9$ |
| Shunt Impedance (MΩ/m) | 16 | 16 |
| Unloaded Q (l/m) | | $5.6 \times 10^4$ |
| Elastance S | $1 \times 10^{13}$ | $1.8 \times 10^{13}$ |

In the first column are shown the parameters for an accelerator operating in a traveling wave mode. The wave power is taken to be 1 GW and the pulse width 50 nsec. The length of a section per single R.F. source is 1 meter. The output beam consists of closely spaced bunches, each of which is of a very short duration (33 ps) which continues for the pulse power duration (less than 6 ns). The number of bunches per pulse is 85. Assuming ten percent efficiency, the number of particles per bunch is $7 \times 10^9$.

In the second column are shown the parameters for an accelerator operating in a traveling wave resonator mode. The wave power is taken to be 250 MW and the pulse width 100 nsec. The length of a section per single R.F. source is 1 meter. To achieve the designed field the resonator is pumped for about 100 nsec. Since the power loss in the resonator walls is very small, the energy losses during the 50 nsec. acceleration time are negligible. The number of bunches per pulse is 94 and the available energy for acceleration, assuming once again a ten percent efficiency, is 1.3 Joules. Therefore the number of particles per bunch is $9 \times 10^9$. In both cases external focusing must be provided to prevent the spread of the bunches due to the self electric fields. In both cases the energy spread is about ±1 percent and the modulation is well matched to the needs of free electron laser systems.

A possible use of the high current bunched beam is to produce high intensity short (33 ps) burst of X-rays for time resolution photography or for other nondestructive diagnostic tools.

The shunt impedance per unit length of the accelerator is the characteristic which measures excellence of a structure as an accelerator. It is defined as the square of the acceleration field per unit length divided by the rf power dissipated per unit length. Thus, a high value of the shunt impedance per unit length is desirable since it means that a high acceleration field can be obtained for a fixed value of the rf power loss per unit length. The shunt impedance can be written as $$R = -A^2 E_O^2 / P_L \tag{54}$$

where A is the ratio between the average acceleration field and the field on axis. $E_o$ is the field on axis, $P_L$ is the rf power dissipated per unit length. A unit length of 1 meter is assumed.

For the case of a $TM_{02}$ mode traveling wave, or a traveling wave resonator accelerator, R is given by $$R = -5.75 \times 10^3 A^2 (f_c/f)^2 f^{\frac{1}{2}} \tag{55}$$

For the case when the accelerator structure is designed to be a cavity a $TM_{02p}$ mode, R is given by $$R=-1.15\times 10^4 A^2(f_c/f)^2 f^{\frac{1}{2}} \quad (56)$$

The unloaded $Q_o$ is defined as the ratio of the energy stored in a cavity to the average energy lost due to rf dissipation in the cavity walls. It may be written as:

$$Q_o=\omega U/P_L \quad (57)$$

where $\omega$ is the angular frequency of the rf power, U is the rf energy stored per unit length and $P_L$ is the rf power loss per unit length.

For the case of a cavity or a traveling wave resonator structure designed to operate in a $TM_{02p}$ mode of 1 meter length made with a copper guide, $Q_o$ is given by $$Q_o=3.97\times 10_9(f/f_c)/f^{\frac{1}{2}} \quad (58)$$

The group velocity $V_g$ is the velocity at which rf energy flows through the accelerator. It is given by $$V_g=c(1-(f_c/f)^2)^{\frac{1}{2}} \quad (59)$$

where c is the speed of light. The filling time $t_F$ of a cavity is given by $$t_F=2Q_L/\omega \quad (60)$$

where $Q_L$ is the loaded Q of the cavity. When the impedance relations are adjusted for maximum steady state energy transfer from the microwave source to the cavity, $Q_L=Q_o/2$ where $Q_o$ is the unloaded Q. Assuming this condition, the filling time for which the stored energy for a $TM_{02p}$ mode in a cavity, per unit length of one meter, has risen to about 75 percent of the steady state value and is given by $$t_F=\frac{1.27\times 10^9(f/f_c)}{f^{3/2}} \quad (61)$$

From equation (61), the filling time for a 35 GHz rf source is 193 nsec, and for 12.5 GHz it is 900 nsec.

A basic parameter for cavities and structures is the elastance, which is a measure of the square of the acceleration field, in terms of the energy stored, per unit length of the structure and is a useful parameter for comparing various linear structures.

The elastance for a $TM_{02}$ mode traveling wave accelerator structure as a function of frequency is given by $$\overline{S}_{TW}=9.1\times 10-^6(f_c/f)^4 A^2 f^2 \text{ (mks)} \quad (62)$$

while for a $TM_{02}$p mode standing wave accelerator structure it is given by $$S_{SW}=1.8\times 10^{-5}(f_c/f)^4 A^2 f^2 \text{ (mks)} \quad (63)$$

The elastance for prior linear accelerator structures operating at 2.8 GHz is $4\times 10^{13}$ (mks). The elastance for the present structure operating in traveling wave mode at the same frequency with $f/f_c=1.06$ is about six times smaller, while for the case when it is operating as a traveling wave resonator (for the same parameters) the elastance is 3.5 times smaller. The main reason the elastance for the present structure is smaller is that the average acceleration field is only one third of the field on axis. ($A=0.33$ for $f/f_c=1.06$). On the other hand, the present structure has a number of advantages over the prior linear accelerator structures, of which the main one is that it can be operated with high frequency, high power and short duration rf sources to achieve a very high acceleration field.

A constant average field acceleration rate depends on the maintenance of a precise phase relation between the field and the particles and on maintenance of the same radial position along the accelerator. If the constructional accuracy is not sufficient, both the acceleration field and the phase angle will change from their respective desired values from period to period. Although the positive and negative errors tend to compensate each other, the magnitude of the accumulated phase error builds up in proportion to the square root of the distance, while the field amplitude suffers an attenuation which is proportional to the mean square of the phase error. A displacement in the particle radial position will result in a change in its energy but not in the phase angle. The error in the phase angle is caused by dimensional error either in the period length of the undulating waveguide or in the diameter of the guide which will cause changes in phase velocity and hence changes in the phase angle.

The change in the phase angle due to constructional error in the synchronous length h can be written as $$\frac{\partial\phi}{\partial h}=360/h \quad (64)$$

The change in the normalized phase velocity $_p$ as a result of a constructional error in the guide radius a is given by $$\frac{\partial\beta_p}{\partial a}=\frac{\beta_p(f_c/f)^2}{a\,1-(f_c/f)^2} \quad (65)$$

From the synchronism condition we get $$\frac{\partial h}{\partial\beta_p}=\frac{h}{(\beta_p-1)} \quad (66)$$

Substituting from equations (64) and (65) into equation (66) the shift in the phase angle due to a change in the guide radius can be written as $$\frac{\partial\phi}{\partial a}=\frac{360\,\beta_p(f_c/f)^2}{a(\beta_p-1)(1-(f_c/f)^2)} \quad (67)$$

from which the constructional tolerance of the guide radius, for a phase shift of 5° and $f/f_c=1.06$, is $$\frac{\delta a}{a}\leqq 2\times 10^{-3} \quad (68)$$

For the same parameters the constructional tolerance of the synchronous length h is $$\frac{\delta h}{h}\leqq 1.5\times 10^{-2} \quad (69)$$

Comparing these two results, it is found that the required constructional accuracy of the guide diameter is an order of magnitude higher than that of the synchronous length. However, since the guide diameter is a few cm the needed accuracy is still within today's machining technology. The required accuracy of the synchronous length is much less restricted. It should be pointed out that even a local change in the guide diameter that is larger than the one given by equation (68) will not cause a large shift in the phase angle, if the length over which it extends is smaller than one synchronous length.

The change in the phase angle as a result of a shift in the operating frequency can be written as $$\frac{\partial\phi}{\partial f} = \frac{360\,\beta_p(f_c/f)^2}{f(\beta_p - 1)(1 - (f_c/f)^2)} \tag{70}$$

from which it is found that, for an allowed shift of 5° in the phase angle and $f/f_c = 1.06$, the required tolerance in the operating frequency is $$\frac{\delta f}{f} \leqq 2 \times 10^{-3} \tag{71}$$

The upper limit on the tuning of the operating frequency is determined by the Q of the accelerator structure and is given by the width of the resonant frequency at half maximum $\Delta f$ where $$\frac{\nabla f}{f} = 1/Q = 2.5 \times 10^{-5} \tag{72}$$

which is two orders of magnitude smaller than that needed, and hence the required tolerance in the operating frequency is achievable. This upper limit is true when the width of the microwave pulse is greater than 1/Q of the cavity.

In the longitudinal direction of the waveguide the accelerating electric field oscillates from zero to the value of the field on axis twice in each periodic length. This oscillation will cause a larger change in the accelerated particle momentum than it would undergo while increasing its energy if the accelerating field was constant. The change in momentum causes energy losses due to radiation. For the case when the particle velocity is almost equal the speed of light, the ratio of the power radiated to the power supplied by the accelerating field is given in rationalized M.K.S. units by $$\frac{P}{dW/dt} = \frac{c\eta_o(e^2/mc^2)}{6\pi\, mc^2}\left(\frac{dW}{dX}\right) \tag{73}$$

where $n_o$ is the intrinsic impedance of free space, and

W is the energy in (Joules).

This shows that the radiation losses due to change in momentum are unimportant unless $dW/dX = 2\times10^{14}$ Mv/m. In the present case $dW/dX = 10^4$ to $10^5$ MV/m and hence the losses due to the longitudinal motion are completely negligible.

The presence of the radial force does lead to transverse acceleration and hence radiation. This radiated power is given as $$P = \frac{c\eta_o e^2\gamma^6}{6\pi c}\,(\dot{\bar{\beta}} - (\bar{\beta}\times\dot{\bar{\beta}})^2) \tag{74}$$

since $\beta_z \cong 1$ and $\beta_z << \beta_r$ and $\gamma = 1/(1-\beta_z^2)^{\frac{1}{2}}$ and as $\dot{\beta}_z = 0\ \dot{\beta} = \dot{\beta}_r$ Substituting in equation (74) the following is obtained:

$$P = \frac{c\eta_o e^2\gamma^4}{6\pi c}\,\dot{\beta}_r^2 \tag{75}$$

Using the radial force given by equation (71) to express $\beta_r$ the following is obtained:

$$\frac{dW}{dt} = \frac{\eta_o\gamma^2 e^4 E_o^2 c}{6\pi m^2 c^3}\,F^2(t,f,f/f_c,r_o/a,z) \tag{76}$$

where $$F(t,f,f/f_c,r_o/a,z) = \frac{\cos X(z)(\beta_p\beta_c^{-1})g}{(\beta_p^2-1)^{\frac{1}{2}}}\,J_1\left(k_c r_o \sin\left(\frac{2\pi z}{\Gamma}\right)\right)\sin(\omega t - k_z z + \phi) + \sin X(z)\,J_o\left(k_c r_o \sin\left(\frac{2\pi z}{\Gamma}\right)\right)\cos(\omega t - k_z z + \phi)$$

The energy loss W per meter length of the accelerator averaged over the periodic length $\Gamma$ is given by $$W = \frac{\eta_o\gamma^2 e^4 E_o^2}{6\pi m^2 c^3}\,L(f,f/f_c,r_o/a,\Gamma) \tag{77}$$

where $L(f, f/f_c, r_o/a, \Gamma)$ is a function which represents a geometrical factor which must be averaged over the undulated structure. For the traveling wave mode of operation it is given by $$L = \langle F^2(t, f, f/f_o\ r_o/a, z)\rangle$$

where $\langle\rangle$ denotes an average over one period length. For the cases when $\beta_p = 3$, $L(f, f/f_c, r_o/a, \Gamma) = 0.10$ to 0.12 and $\beta_p = 2$, $L(f, f/f_c, r_o/a, \Gamma) = 0.06 \div 0.08$.

The radiation losses for the cavity mode of operation are given by the same expression as in the traveling wave mode but the function $L(f, f/f_c, r_o/a, \Gamma)$ will be slightly different. Since the losses scale as the axial field strength squared they are somewhat larger in the cavity case. The accelerator is operated in traveling wave mode at f=35 GHz, $f/f_c = 1.06$, W=100 MV/m. From this it can be seen that only at 1 TeV is the radiated energy equal to the energy the particle gain.

In all the results discussed above it has been assumed that the particle drift velocity is equal to the speed of light, and that the phase velocity of the wave is constant. The first assumption is justified in dealing with highly relativistic particles, while the second assumption is only an approximation made mainly to simplify the analysis. In reality the phase velocity along the particle trajectory, the z axis shown at 14 in FIG. 1, is not constant but has a small modulation where the amplitude and the frequency of the modulation are determined by the accelerator structure, and will stay the same along the accelerator. Therefore this modulation will be followed by a phase angle modulation with the same frequency, since the phase angle is determined by the phase velocity. The phase angle amplitude, for $f/f_c=1.06$, is of the order of 5 to 10 degrees. Under the above two assumptions it has been found that the spread in the particle energy is ±1.0 percent for a ±10 degree acceptance angle around the synchronous angle $\phi=0.0$. Taking into account the effect of the phase angle oscillation, which will 'average' the energy of the particles in the bunch along the whole length of the accelerator and because the amplitude of the phase oscillation is independent of the particle energy, the energy spread of the particles at the output will be much smaller. Another important result is that, as opposed to prior linera accelerators, the phase angle of the synchronous particle is $\phi=0.0$ for which the acceleration field is maximum, and the acceptance phase angle is located symmetrically around $\phi=0.0$. In prior linear accelerators the phase angle of the synchronous particle is not at the maximum acceleration field ($\phi=90°$) but is chosen to be about 70° to 80°. The reason for this basic difference is that in the present case the wave is slipping through the particles and so the particles will be accelerated even if the phase angle is on the negative side of the crest of the propagating wave. In a conventional rf linear accelerator, particles on the negative side of the propagating wave crest will be decelerated and be lost from the bunch.

The key issue of the present accelerator concept is, how the periodic variations in the undulating waveguide affect the characteristics of the wave. To analyze this, consider a smooth circular waveguide in which the axial electric field for a $TM_{On}$ mode is given by $$E_z(z,r,t)=E_oJ_o(k_cr)\exp j(\omega t-k_zz) \tag{79}$$

where $E_o$ is a constant given by equation (12) and $k_z$ is the wave vector parallel to the z axis.

The field on axis, r=0, is given by $$E_z(z,r=0,t)=E_o\exp j(\omega t-k_zz) \tag{80}$$

On the other hand, the field on axis (along z) in the undulating waveguide is given by $$E_z(z,r,t)=E_o(z)J_o(k_cr(z))\exp j(\omega t-\overrightarrow{(k_z)_s}\cdot\vec{z}) \tag{81}$$

where $E_o(z)=E_o\cos X(z)$.

$\overrightarrow{(k_z)_s}\cdot\vec{z}=K_zz\cos X(z)$, $\overrightarrow{(k_z)_s}$ is the wave vector along the undulated waveguide axis; and $r(z)=r_o\sin(2\pi z/\Gamma)$.

where $r_o$ is the amplitude of the undulation;

$\Gamma$ is the periodic length of the undulation, and

X(z) is the angle between the axis of the undulated waveguide and the axis z, as given by equation (18).

Further, the value of the function cos X(z) as a function of z along one undulator period can be written as:

$$\cos X(z)=\cos(\epsilon\cos k_\Gamma z)$$

where $k_\Gamma=2\pi/\Gamma$, and $\epsilon=X(z=0)<1$.

Substituting into (81) the following is obtained:

$$E_z(z,r,t)=\cos X(z)E_oJ_o(k_cr(z))\exp j(\omega t-k_zz\cos(\epsilon\cos k_\Gamma z)) \tag{82}$$

from which it is learned that the phase velocity of the wave which is given by $$V_P=\omega/k_z\cos(\epsilon\cos k_\Gamma z)$$

will not be constant along the x axis, but instead is modulated. As $\epsilon\cos(k_\Gamma z)$ is a small angle, and to simplify the expression of $E_z(z)$, the following approximations are made:

$$\begin{aligned}\cos(\epsilon\cos k_\Gamma z) &= 1-\frac{\epsilon^2}{2}\cos^2k_\Gamma z \\ &= 1-\frac{\epsilon^2}{2}+\frac{\epsilon^2}{2}\sin^2k_\Gamma z<1-\frac{\epsilon^2}{2}+\frac{\epsilon^2}{2}\sin k_\Gamma z\end{aligned} \tag{83}$$

In the last step a larger phase modulation is allowed, but as $\epsilon^2/2<<1$ this will not lead to a significant increase in the phase modulation. Using this approximation, the real part of the field along z is given by $$Re(E_z(z,r,t))=\cos X(z)\,E_oJ_o(k_cr(z))\cos(\omega t-k_zz+\rho-\rho\sin k_\Gamma z) \tag{84}$$

$$\rho=\frac{\epsilon^2}{2}$$

where Equation (84) can also be written as $$Re(E_z(z,r,t))=\cos X(z)E_oJ_o(k_cr(z))\{\cos\theta\cos(\rho\sin k_\Gamma z)-\sin\theta\sin(\rho\sin k_\Gamma z)\} \tag{85}$$

where $\theta=\omega t-k_zz+\rho$

As $\cos(\rho\sin k_\Gamma z)$ and $\sin(\rho\sin k_\Gamma z)$ are periodic functions of $k_\Gamma$ they can be expanded via Fourier series to obtain $$\begin{aligned}\cos(\rho\sin k_\Gamma z) &= J_o(\rho)+\sum_{n=\text{even}}^{\infty}2J_n(\rho)\cos nk_\Gamma z \\ \sin(\rho\sin k_\Gamma z) &= \sum_{n=\text{odd}}^{\infty}2J_n(\rho)\sin k_\Gamma z\end{aligned} \tag{86}$$

where $J_n(p)$ are Bessel functions of the first kind of order n. Substituting (86) into (85) and using the property that $J_{-n}(\rho)=(-1)^nJ_n(\rho)$ the real part of the electric field on axis can be written as $$Re(E_z(z,r,t))=\cos X(z)\,E_oJ_o(k_cr(z))\sum_{n=-\infty}^{\infty}J_n(\rho)\cos(\omega t-k_zz-nk_\Gamma z+\rho). \tag{87}$$

Following the same procedure the imaginary part of the electric field on axis is given by $$Im(E_z(z,r,t))=\cos X(z)\,E_oJ_o(k_cr(z))\sum_{n=-\infty}^{\infty}J_n(\rho)\sin(\omega t-k_zz-nk_\Gamma z+\rho). \tag{88}$$

Combining the last two equations, the electric field on axis can be written as $$E_z(z,r,t)= \tag{89}$$

-continued $$\cos X(z)\, E_o J_o\,(k_c r(z)) \sum_{n=-\infty}^{\infty} J_n(\rho)\exp j(\omega t - (k_z + nk_\Gamma)z + \rho).$$

From equation (89) it is seen that the main effects of the undulations in the waveguide are that the amplitude of the field on axis is not constant but is modulated, that a full set of "space harmonics" are felt by the particle, and that all of them have the same frequency but different phase velocity. The phase velocity of each one of them is given by $$V_{pn} = \frac{\omega}{k_z + nk_\Gamma}$$

The amplitudes of the "space harmonics" modes are related to each other as the Bessel function $J_n(\rho)$. Further, it is seen that the argument of the Bessel function $\rho$ is a function of the undulating waveguide parameters $r_o$ and $\Gamma$, as for the cases of interest $r_o/\pi << 1$ so $\rho << 1$ and the amplitudes of all the higher modes are very small compared to the zero mode since $J_o(\rho) << J_n(\rho)$ for $\rho << 1$, where $n = 1, 2 \ldots$.

In accordance with the present invention, an electromagnetic accelerating wave source such as a backward wave oscillator will produce a wave which will interact with an intense, relativistic electron beam in passing through a waveguide with an undulating wall, the electron beam preferably interacting with the $TM_{02}$ mode of the electromagnetic wave. The phase velocity of the electromagnetic wave is greater than that of the electrons, so as to obtain an electron phase slip to obtain acceleration. This is accomplished by shaping the waveguide by superimposing a helical wave structure or a linear sinusoidal form on an otherwise straight waveguide. Substantially continuous acceleration of the electrons is achieved when the electrons slip one cycle of the rf wave in every period of the waveguide structure. Acceleration is accomplished by the central peak of the $TM_{02}$ electromagnetic wave when the electrons are centered in the waveguide; accordingly, the electrons are directed along a beam path which passes in an essentially straight line through the undulating waveguide. As a result, the electrons which are initially at the axial center of the waveguide are, a half period of the structure later, close to the waveguide walls. When this operation coincides with the $TM_{02}$ wave form propagating through the structure, the electrons interact with the second peak of the electromagnetic wave when they are near the waveguide walls. This alternating interaction with the central and second peaks of the $TM_{02}$ electromagnetic wave mode, together with the slip of the electrons relative to the electromagnetic wave, insure that the electrons are continuously accelerated throughout substantially the whole period of the structure. This produces acceleration of the electrons along the direction of their motion and had a substantial advantage over prior devices such as the inverse free electron laser since it reduces synchroton radiation to tolerable levels.

The field gradient in the present invention may be produced by a traveling electromagnetic wave, or may be further enhanced by using a standing wave in the accelerator, where reflection of the electromagnetic wave from an iris downstream in the waveguide leads to a doubling of the electric field. Further increases in the field gradient may be achieved by setting up $TM_{02}$ modes in a closed oval or "race track" cavity in which acceleration is accomplished by imposing a helical or sinusoidal curvature on one of the long sides of the cavity.

Transverse focusing of the electron beam being accelerated through the cavity is not a problem since the radial accelerating field reverses in every cycle of the structure, and thus is averaged out through the length of the waveguide. However, in some cases it may be necessary to superimpose a magnetic focusing lens on the structure in order to improve the beam quality. There can also be an advantage in making the structure completely symmetric with respect to the electron trajectory; that is, making the period of the structure twice that described above with an odd symmetry imposed on the curvature of the structure about the midpoint of the system. In this way electrostatic forces tending to defocus the beam as a result of image charges will average out to zero. Thus, the present invention provides a novel, high-field gradient accelerator which works on the principle of propagating an electron through a travelling or standing wave in a $TM_{02}$ mode of the waveguide. The guide is shaped in an undulating fashion so that an electron travelling through it samples all radial positions in such a way tha the particle is continuously accelerated throughout the structure. It is expected that field gradients in excess of 100 MV/m should be achievable at frequencies of about 35 GHz.

What is claimed is:

1. A high electric field gradient phase slip accelerator for particles, comprising a source of high power, short duration microwave frequency electromagnetic energy;

a smooth bore, periodic undulating waveguide section having a longitudinal axis and a constant period of undulation;

means directing said microwave energy to propagate through said undulating waveguide section in a predetermined mode;

means for generating particles to be accelerated;

means directing said particles axially through said waveguide section to interact with said microwave energy, said period of undulation of said undulating waveguide section being selected so that particles travelling along said axis slip an integral number of cycles of said electromagnetic wave energy every period of the waveguide section to obtain substantially continuous acceleration in the direction of propagation of said electromagnetic energy so that said particles are accelerated by said propagating microwave energy.

2. The accelerator of claim 1, wherein said undulating waveguide section varies essentially sinusoidally along its length about its longitudinal axis.

3. The accelerator of claim 1, wherein said undulating waveguide section varies helically along its length along its longitudinal axis.

4. The accelerator of claim 1, wherein said microwave energy propagates through said undulating waveguide section in a travelling $TM_{02}$ mode to produce a maximum axial electric field along said longitudinal axis and a zero axial electric field at the side wall of said waveguide section.

5. The accelerator of claim 1, further including means to produce a standing wave of said microwave energy in said undulating waveguide section, said microwave energy having a $TM_{02}$ mode to produce a maximum axial electric field along said longitudinal axis and a zero axial electric field at the side wall of said waveguide section.

6. The accelerator of claim 1, wherein said particles are electrons forming an electron beam.

7. The accelerator of claim 6, wherein said electromagnetic wave has a phase velocity greater than the velocity of said electrons,

8. The accelerator of claim 1, wherein said undulating waveguide section forms a part of a closed loop waveguide, whereby said electromagnetic waves propagate around said closed loop to form travelling waves.

9. A method of producing high energy particles, comprising:

propagating a short duration, high power electromagnetic wave through a periodic undulating waveguide section at a first phase velocity;

injecting a beam of particles into said undulating waveguide section at a second velocity which is smaller than said first phase velocity by an amount to cause said particles to slip two cycles of the electromagnetic wave for a cylindrical guide, and one cycle of the electromagnetic wave for a rectangular guide, for every period of said undulating waveguide section; and causing said beam of particles to travel axially along said undulating waveguide section to interact with said electromagnetic wave and to accelerate said particles.

10. The method of claim 9, further including causing said beam of particles to interact with a $TM_{02}$ mode of said electromagnetic wave having a peak axial field value at the axis of said waveguide and a zero axial field value at the wall of said waveguide.

11. The method of claim 10, wherein the travel of said beam of particles axially along said undulating waveguide section causes said particles to sample said electromagnetic field at varying radii throughout said waveguide section, whereby said particles are accelerated by an average field which is a fraction of the peak value of said electromagnetic field.

12. The method of claim 11, wherein said electromagnetic wave is propagated as a travelling wave through said undulating waveguide section.

13. The method of claim 11, wherein said electromagnetic wave is a standing wave in said undulating waveguide section.

14. The method of claim 9, further including shaping said waveguide section to cause said beam of particles to sample varying radial positions throughout said waveguide section to produce continual acceleration of said particles.

15. The method of claim 14, wherein the shaping of said waveguide section includes varying the waveguide section essentially sinusoidally along its longitudinal axis.

16. The method of claim 14, wherein the shaping of said waveguide section includes varying the waveguide section essentially helically along its longitudinal axis.

* * * * *